US012410496B2

(12) United States Patent
Fluch et al.

(10) Patent No.: US 12,410,496 B2
(45) Date of Patent: Sep. 9, 2025

(54) SUPERAUSTENITIC MATERIAL

(71) Applicant: voestalpine BÖHLER Edelstahl GmbH & Co KG, Kapfenberg (AT)

(72) Inventors: Rainer Fluch, St. Lorenzen im Mürztal (AT); Andreas Keplinger, Leoben (AT)

(73) Assignee: voestalpine BOHLER Edelstahl GmbH & Co. KG, Kapfenberg (AT)

( * ) Notice: Subject to any disclaimer, the term of this patent is extended or adjusted under 35 U.S.C. 154(b) by 957 days.

(21) Appl. No.: 17/414,008

(22) PCT Filed: Dec. 19, 2019

(86) PCT No.: PCT/EP2019/086384
§ 371 (c)(1),
(2) Date: Nov. 18, 2021

(87) PCT Pub. No.: WO2020/127788
PCT Pub. Date: Jun. 25, 2020

(65) Prior Publication Data

US 2023/0332282 A1 Oct. 19, 2023
US 2024/0052469 A2 Feb. 15, 2024

(30) Foreign Application Priority Data

Dec. 20, 2018 (DE) ..... 10 2018 133 255.6

(51) Int. Cl.
*C22C 38/54* (2006.01)
*C21D 7/02* (2006.01)
(Continued)

(52) U.S. Cl.
CPC ..... *C22C 38/54* (2013.01); *C21D 7/02* (2013.01); *C21D 7/13* (2013.01); *C21D 8/0205* (2013.01);
(Continued)

(58) Field of Classification Search
None
See application file for complete search history.

(56) References Cited

U.S. PATENT DOCUMENTS 4,554,028 A 11/1985 Debold et al.
6,300,001 B1 * 10/2001 Hornung ..... C22C 38/001 429/492
(Continued)

FOREIGN PATENT DOCUMENTS

AT 277302 12/1969
CA 1238841 7/1988
(Continued)

OTHER PUBLICATIONS

"Steel Hardness Conversion Table." Steel Express Limited. https://www.steelexpress.co.uk/steel-hardness-conversion.html. Accessed Mar. 8, 2025. (Year: 2025).*
(Continued)

*Primary Examiner* — Brian D Walck
(74) *Attorney, Agent, or Firm* — Maxwell J. Petersen; FisherBroyles, LLP

(57) ABSTRACT

A superaustenitic material is provided for use in chemical plant construction or in oilfield or gas field technology. The material resists corrosion, in particular corrosion in mediums with high chloride concentrations and sulfuric acid.

23 Claims, 5 Drawing Sheets

| Alloying element | Composition range | Preferred | **More preferred** |
|---|---|---|---|
| Carbon (C) | 0.01 - 0.25 | 0.01 - 0.20 | 0.01 - 0.10 |
| Silicon (Si) | < 0.5 | < 0.5 | < 0.5 |
| Manganese (Mn) | 3.0 - 8.0 | 4.0 - 7.0 | 5.0 - 6.0 |
| Phosphorus (P) | < 0.05 | < 0.05 | < 0.05 |
| Sulfur (S) | < 0.005 | < 0.005 | < 0.005 |
| Iron (Fe) | residual | residual | residual |
| Chromium (Cr) | 23.0 - 30.0 | 24.0 - 28.0 | 26.0 - 28.0 |
| Molybdenum (Mo) | 2.0 - 4.0 | 2.5 - 3.5 | 2.5 - 3.5 |
| Nickel (Ni) | 10.0 - 16.0 | 12.0 - 15.5 | 13.0 - 15.0 |
| Vanadium (V) | < 0.5 | < 0.3 | below detection limit |
| Tungsten (W) | < 0.5 | < 0.1 | below detection limit |
| Copper (Cu) | < 0.5 | < 0.15 | < 1.0 |
| Cobalt (Co) | < 5.0 | < 0.5 | below detection limit |
| Titanium (Ti) | < 0.1 | < 0.05 | below detection limit |
| Aluminum (Al) | < 0.2 | < 0.1 | < 0.1 |
| Niobium (Nb) | < 0.1 | < 0.025 | below detection limit |
| Boron (B) | < 0.01 | < 0.005 | < 0.005 |
| Nitrogen (N) | 0.50 - 0.90 | 0.52 - 0.85 | 0.54 - 0.80 |

All values expressed in percentage by weight

(51) Int. Cl.

| | |
|---|---|
| ***C21D 7/13*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/42*** | (2006.01) |
| ***C22C 38/44*** | (2006.01) |
| ***C22C 38/52*** | (2006.01) |
| ***C22C 38/58*** | (2006.01) |

(52) U.S. Cl.
CPC ..... *C21D 8/0273* (2013.01); *C22C 38/001* (2013.01); *C22C 38/002* (2013.01); *C22C 38/02* (2013.01); *C22C 38/04* (2013.01); *C22C 38/42* (2013.01); *C22C 38/44* (2013.01); *C22C 38/52* (2013.01); *C22C 38/58* (2013.01); *C21D 2211/001* (2013.01)

(56) References Cited

U.S. PATENT DOCUMENTS

| | | | | |
|---|---|---|---|---|
| 9,803,267 | B2 | 10/2017 | Roscoe | |
| 2005/0194073 | A1* | 9/2005 | Hamano | C22C 38/001 148/326 |
| 2014/0238552 | A1 | 8/2014 | Forbes Jones et al. | |
| 2014/0261918 | A1* | 9/2014 | Jin | C21D 8/005 148/333 |
| 2014/0338800 | A1* | 11/2014 | Leinonen | C21D 8/0247 148/567 |
| 2015/0129093 | A1* | 5/2015 | Forbes Jones | C21D 8/005 148/609 |
| 2015/0337419 | A1* | 11/2015 | Magee | C22C 38/02 420/45 |
| 2019/0112694 | A1* | 4/2019 | Takagi | C22C 38/46 |
| 2022/0033924 | A1 | 2/2022 | Fluch et al. | |
| 2022/0145436 | A1 | 5/2022 | Fluch et al. | |

FOREIGN PATENT DOCUMENTS

| | | | |
|---|---|---|---|
| CA | 3122044 | A1 | 6/2020 |
| CN | 106555133 | A | 4/2017 |
| DE | 3445056 | A1 | 6/1985 |
| DE | 3837457 | | 12/1989 |
| DE | 3837457 | C1 | 12/1989 |
| DE | 3837456 | | 3/1990 |
| DE | 29921813 | | 2/2000 |
| EP | 0342574 | A1 | 5/1989 |
| EP | 1577414 | A2 | 9/2005 |
| EP | 1577414 | A3 | 11/2005 |
| EP | 2794949 | | 10/2014 |
| EP | 3899064 | A1 | 6/2020 |
| GB | 778597 | | 2/1956 |
| JP | S55021547 | | 2/1980 |
| JP | H0426740 | A | 1/1992 |
| JP | H09279315 | | 10/1997 |
| JP | 2005179733 | | 7/2005 |
| JP | 2005179733 | A | 7/2005 |
| JP | 281855 | A | 10/2005 |
| KR | 20030057135 | | 7/2003 |
| KR | 20030057135 | A | 7/2003 |
| WO | 1997012072 | A1 | 4/1997 |
| WO | 0164969 | A1 | 9/2001 |
| WO | 20005073424 | | 8/2005 |
| WO | 2011040381 | A1 | 2/2013 |
| WO | 2013130139 | A2 | 9/2013 |
| WO | 2013130139 | A3 | 9/2013 |
| WO | 2020127788 | A1 | 6/2020 |
| WO | 2020127789 | A1 | 6/2020 |

OTHER PUBLICATIONS

Office Action in German Patent Application DE 10 2018 133 255.6, dated Sep. 19, 2019.
International Search Report and Written Opinion for PCT/EP2019/086385.
International Search Report and Written Opinion for PCT/EP2019/086384.
Deurig, "Shape Memory Alloys," ASTM Handbook, vol. 23, Materials for Medical Devices, pp. 237-350 (2012).

* cited by examiner

| Alloying element | Composition range | Preferred | **More preferred** |
|---|---|---|---|
| Carbon (C) | 0.01 - 0.25 | 0.01 - 0.20 | 0.01 - 0.10 |
| Silicon (Si) | < 0.5 | < 0.5 | < 0.5 |
| Manganese (Mn) | 3.0 - 8.0 | 4.0 - 7.0 | 5.0 - 6.0 |
| Phosphorus (P) | < 0.05 | < 0.05 | < 0.05 |
| Sulfur (S) | < 0.005 | < 0.005 | < 0.005 |
| Iron (Fe) | residual | residual | residual |
| Chromium (Cr) | 23.0 - 30.0 | 24.0 - 28.0 | 26.0 - 28.0 |
| Molybdenum (Mo) | 2.0 - 4.0 | 2.5 - 3.5 | 2.5 - 3.5 |
| Nickel (Ni) | 10.0 - 16.0 | 12.0 - 15.5 | 13.0 - 15.0 |
| Vanadium (V) | < 0.5 | < 0.3 | below detection limit |
| Tungsten (W) | < 0.5 | < 0.1 | below detection limit |
| Copper (Cu) | < 0.5 | < 0.15 | < 1.0 |
| Cobalt (Co) | < 5.0 | < 0.5 | below detection limit |
| Titanium (Ti) | < 0.1 | < 0.05 | below detection limit |
| Aluminum (Al) | < 0.2 | < 0.1 | < 0.1 |
| Niobium (Nb) | < 0.1 | < 0.025 | below detection limit |
| Boron (B) | < 0.01 | < 0.005 | < 0.005 |
| Nitrogen (N) | 0.50 - 0.90 | 0.52 - 0.85 | 0.54 - 0.80 |

All values expressed in percentage by weight

Fig. 1

| Examples according to the invention | Chemical composition (percentage by weight) / residual Fe | | | | | | | | | | | | | | | N solubility [%N] | | | | | | |
|---|---|---|---|---|---|---|---|---|---|---|---|---|---|---|---|---|---|---|---|---|---|---|
| | | | | | | | | | | | | | | | Pressure | Stein | Satir | Kowanda | Medovar at temperature: | | | |
| | C | Si | Mn | Cr | Mo | Ni | V | W* | Cu | Co* | Ti* | Al* | Nb* | N | [MPa] | | | | 1550°C | 1525°C | 1500°C | 1450°C |
| A | 0.01 | 0.4 | 5.0 | 23.01 | 3.1 | 15.98 | 0.05 | 0 | 0.15 | 0 | 0 | 0 | 0 | 0.51 | 1.00 | 0.38 | 0.30 | 0.34 | 0.34 | 0.35 | 0.36 | 0.39 |
| B | 0.01 | 0.4 | 5.0 | 27 | 3.1 | 14 | 0.05 | 0 | 0.10 | 0 | 0 | 0 | 0 | 0.7 | 1.00 | 0.61 | 0.41 | 0.65 | 0.47 | 0.48 | 0.51 | 0.56 |
| C | 0.01 | 0.4 | 5.0 | 24 | 3.1 | 14 | 0.05 | 0 | 0.10 | 0 | 0 | 0 | 0 | 0.55 | 1.00 | 0.44 | 0.34 | 0.45 | 0.38 | 0.40 | 0.41 | 0.45 |

Actual value N

Calculated values for N according to different methods (Source: On Restricting Aspects in the Production of Nonmagnetic Cr-Mn-N-Alloyed Steels, Saller, 2005)

* .... Values are below the detectable level

Fig. 3

Mechanical properties of the alloys from Fig. 3 produced according to the invention after strain hardening

| Alloy | Rp 0.2 [MPa] | Rm [MPa] | A4 [%] | Charpy V notched-bar toughness [Joule] | Rm * KV [MPa J] |
|---|---|---|---|---|---|
| A | 969 | 1111 | 30 | 271 | 301303 |
| B | 1171 | 1231 | 27 | 290 | 357236 |
| C | 1124 | 1207 | 26 | 329 | 370588 |

Fig. 4

| | C (%) | Si (%) | Mn (%) | Cr (%) | Mo (%) | Ni (%) | Nb (%) | N (%) | Use |
|---|---|---|---|---|---|---|---|---|---|
| LL | 0.010 | 0* | 3.00 | 23.0 | 2.50 | 14.00 | 0* | 0.50 | Shipbuilding, chemical plant construction |
| UL | 0.030 | 0.50 | 6.00 | 25.0 | 3.50 | 16.00 | 0.10 | 0.60 | |
| LL | 0.010 | 0* | 4.00 | 23.50 | 3.00 | 12.00 | 0* | 0.50 | Axle drives, pumps, |
| UL | 0.030 | 0.50 | 7.00 | 26.00 | 4.00 | 15.00 | 0.10 | 0.70 | seawater purification plants |
| LL | 0.010 | 0* | 5.00 | 26.00 | 3.00 | 11.00 | 0* | 0.50 | Flexible pipes, wire lines, screws and bolts, |
| UL | 0.050 | 0.50 | 8.00 | 30.00 | 4.00 | 14.50 | 0.10 | 0.90 | completion tools |

LL = Lower limit
UL = Upper limit

* ... Values are below the detection limit,
i.e. are not intentionally added to the alloy

Fig. 5

SUPERAUSTENITIC MATERIAL

RELATED APPLICATIONS

This patent application is a 35 U.S.C. § 371 National Stage application based on and claiming priority to International Application PCT/EP2019/086384, filed on Dec. 19, 2019, which in turn claims priority based on German Application DE 2018 133 255.6, filed on Dec. 20, 2018, the disclosures of which are incorporated by reference in their entireties.

FIELD OF THE INVENTION

The invention relates to a superaustenitic material and a method for producing it.

BACKGROUND OF THE INVENTION

Materials of this kind are used, for example, in chemical plant construction or in oilfield or gas field technology.

One requirement of materials of this kind is that they must resist corrosion, in particular corrosion in mediums with high chloride concentrations.

Materials of this kind are known, for example, from CN 107876562 A, CN 104195446 A, or DE 43 42 188.

EP 1 069 202 A1 has disclosed a paramagnetic, corrosion-resistant austenitic steel with a high yield strength, strength, and toughness, which should be corrosion-resistant particularly in mediums with a high chloride concentration; this steel should contain 0.6% by weight to 1.4% by weight nitrogen, and 17 to 24% by weight chromium, as well as manganese and nitrogen.

WO 02/02837 A1 has disclosed a corrosion-resistant material for use in mediums with a high chloride concentration in oilfield technology. In this case, it is a chromium-nickel-molybdenum superaustenite, which is embodied with comparatively low nitrogen concentrations, but very high chromium concentrations and very high nickel concentrations.

By comparison to the previously mentioned chromium-manganese-nitrogen steels, these chromium-nickel-molybdenum steels usually have an even better corrosion behavior.

By and large, chromium-manganese-nitrogen steels constitute a rather inexpensive alloy composition, which nevertheless offers an outstanding combination of strength, toughness, and corrosion resistance. The above-mentioned chromium-nickel-molybdenum steels achieve significantly higher corrosion resistances than chromium-manganese-nitrogen steels, but entail significantly higher costs because of the very high nickel content.

Characteristic values for the corrosion resistance include among others the so-called $PREN_{16}$ value; it is also customary to define the so-called pitting equivalent number by means of MARC; a superaustenite is identified as having a $PREN_{16}$ of $\alpha>42$, where PREN=% Cr+3.3×% Mo+16×% N.

The known MARC formula for describing the pitting resistance for steels of this kind is the following: MARC=% Cr+3.3×% Mo+20×% N+20×% C−0.25×% Ni−0.5×% Mn.

Comparable steel grades are also known for use as shipbuilding steels for submarines; in this case, these are chromium-nickel-manganese-nitrogen steels, which are also alloyed with niobium in order to stabilize the carbon, but this diminishes the notched-bar toughness. Basically, these steels contain little manganese and as a result, have a relatively good corrosion resistance, but they do not yet achieve the strength of drilling collar grades.

Known superaustenites usually have molybdenum concentrations>4% in order to achieve the high corrosion resistance. But molybdenum increases the segregation tendency and thus produces an increased susceptibility to precipitation (particularly of sigma or chi phases), which results in the fact that these alloys require a homogenization annealing and at values above 6% molybdenum, a remelting is required in order to reduce the segregation.

SUMMARY OF THE INVENTION

The object of the invention is to produce a superaustenitic, high-strength, and tough material, which can be produced in a comparatively simple and inexpensive way.

The object is attained with a material having the features described and claimed herein. Advantageous modifications are also described and claimed herein.

Another object of the invention is to create a method for producing the material.

The object is attained with the features described and claimed herein. Advantageous modifications are also described and claimed herein.

If percentage values are given below, they are always expressed in wt % (percentage by weight).

According to the invention, the material is intended for use in the measuring device industry and particularly also in the watchmaking industry, particularly in housings for high-sensitivity measuring devices and for screw-carrying axle drives, pumps, flexible pipes, wire lines, in chemical plant construction, and in seawater purification plants, and should have a fully austenitic structure even after an optional cold forming; after the strain hardening, the yield strength should be $R_{p0.2}>1000$ MPa.

The alloy according to the invention comprises the following elements in particular:

| Elements | | Preferred | More preferred |
|---|---|---|---|
| Carbon (C) | 0.01-0.25 | 0.01-0.20 | 0.01-0.1 |
| Silicon (Si) | <0.5 | <0.5 | <0.5 |
| Manganese (Mn) | 3.0-8.0 | 4.0-7.0 | 5.0-6.0 |
| Phosphorus (P) | <0.05 | <0.05 | <0.05 |
| Sulfur (S) | <0.005 | <0.005 | <0.005 |
| Iron (Fe) | residual | residual | residual |
| Chromium (Cr) | 23.0-30.0 | 24.0-28.0 | 26.0-28.0 |
| Molybdenum (Mo) | 2.0-4.0 | 2.5-3.5 | 2.5-3.5 |
| Nickel (Ni) | 10.0-16.0 | 12.0-15.5 | 13.0-15.0 |
| Vanadium (V) | <0.5 | <0.3 | below detection limit |
| Tungsten (W) | <0.5 | <0.1 | below detection limit |
| Copper (Cu) | <0.5 | <0.15 | below detection limit |
| Cobalt (Co) | <5.0 | <0.5 | below detection limit |
| Titanium (Ti) | <0.1 | <0.05 | below detection limit |
| Aluminum (Al) | <0.2 | <0.1 | <0.1 |
| Niobium (Nb) | <0.1 | <0.025 | below detection limit |
| Boron (B) | <0.01 | <0.005 | <0.005 |
| Nitrogen (N) | 0.50-0.90 | 0.52-0.85 | 0.54-0.80 |

With such an alloy, the positive properties of different known steel grades are combined in a synergistic and surprising way.

Basically, the steel according to the invention should exist in a precipitation-free state since precipitation has a negative effect on the toughness and the corrosion resistance.

After the hot forming step to which the cast block has been subjected, the yield strength is $R_{p0.2}>450$ MPa and can easily attain values>500 MPa; the notched bar impact work at 20° C. is greater than 350 J and even values of up to 440 J are achieved.

After the strain hardening, the yield strength is reliably $R_{p0.2}$>1000 MPa and experience has shown that values of up to 1100 MPa are achieved; after the strain hardening, the notched bar impact work at 20° C. is reliably greater than 80 J and experience has shown that values of 200 J are achieved.

The notched bar impact work was determined in accordance with DIN EN ISO 148-1.

This outstanding combination of strength and toughness was not previously achievable and was also not expected and is accomplished by the special alloying state according to the invention, which produces this synergistic effect.

According to the invention, it is possible to achieve values for the product of tensile strength Rm multiplied by the notched-bar toughness KV that are greater than 100000 MPa J, preferably >200000 MPa J, and particularly preferably >300000 MPa J.

With the alloy according to the invention, it is entirely surprising that very high nitrogen values can be established, which is extremely good for the strength; these nitrogen values are surprisingly higher than those that are indicated as possible in the technical literature. According to empirical methods, the high nitrogen concentrations of the alloy according to the invention were not possible at all.

The respective elements are described in detail below, in combination with the other alloy components where appropriate. All indications relating to the alloy composition are expressed in percentage by weight (wt %). Upper and lower limits of the individual alloy elements can be freely combined with each other within the limits of the claims.

Carbon can be present in a steel alloy according to the invention at concentrations of up to 0.25%. Carbon is an austenite promoter and has a beneficial effect with regard to high mechanical characteristic values. With regard to avoiding carbide precipitation, the carbon content should be set between 0.01 and 0.20% by weight, in particular between 0.01 and 0.10% by weight.

Silicon is provided in concentrations of up to 0.5% by weight and mainly serves to deoxidize the steel. The indicated upper limit reliably avoids the formation of intermetallic phases. Since silicon is also a ferrite promoter, in this regard as well, the upper limit is selected with a safety range. In particular, silicon can be provided in concentrations of 0.1-0.3% by weight.

Manganese is present in concentrations of 3-8% by weight. In comparison to materials according to the prior art, this is an extremely low value. Up to this point, it has been assumed that manganese concentrations of greater than 19% by weight, preferably greater than 20% by weight are required for a high nitrogen solubility. With the present alloy, it has surprisingly turned out that even with the low manganese concentrations according to the invention, a nitrogen solubility is achieved that is greater than what is possible according to the prevailing consensus among experts. In addition, it has been assumed up to this point that a good corrosion resistance is accompanied by very high manganese concentrations, but according to the invention, it has turned out that due to unexplained synergistic effects, this is clearly not necessary with the present alloy. The lower limit for manganese can be selected as 3.0, 3.5, 4.0, 4.5, or 5.0%. The upper limit for manganese can be selected as 6.0, 6.5, 7.0, 7.5, or 8.0%.

In concentrations of 17% by weight or more, chromium turns out to be necessary for a higher corrosion resistance. According to the invention, a concentration of at least 23% and at most 30% chromium is present. Up to this point, it has been assumed that concentrations higher than 24% by weight have a disadvantageous effect on the magnetic permeability because chromium is one of the ferrite-stabilizing elements. By contrast, in the alloy according to the invention, it has been determined that even very high chromium concentrations above 23% do not negatively influence the magnetic permeability in the present alloy but instead—as is known—influence the resistance to pitting and stress crack corrosion in an optimal way. The lower limit for chromium can be selected as 23, 24, 25, or 26%. The upper limit for chromium can be selected as 28, 29, or 30%.

Molybdenum is an element that contributes significantly to corrosion resistance in general and to pitting corrosion resistance in particular; the effect of molybdenum is intensified by nickel. According to the invention, 2.0 to 4% by weight molybdenum is added. The lower limit for molybdenum can be selected as 2.0, 2.1, 2.2, 2.3, 2.4, or 2.5%. The upper limit for molybdenum can be selected as 3.5, 3.6, 3.7, 3.8, 3.9, or 4.0%. Higher concentrations of molybdenum make an ESR treatment absolutely necessary in order to prevent occurrences of segregation. Remelting procedures are very complex and expensive. For this reason, PESR or ESR routes are to be avoided according to the invention.

According to the invention, tungsten is present in concentrations of less than 0.5% and contributes to increasing the corrosion resistance. The upper limit for tungsten can be selected as 0.5, 0.4, 0.3, 0.2, 0.1%, or below the detection limit (i.e. without any intentional addition to the alloy).

According to the invention, nickel is present in concentrations of 10 to 16%, which achieves a high stress crack corrosion resistance in mediums containing chloride. The lower limit for nickel can be selected as 10, 11, 12, or 13%. The upper limit for nickel can be selected as 15, 15.5, or 16%.

Although according to the literature, the addition of copper to the alloy turns out to be advantageous for the resistance in sulfuric acid, it has turned out according to the invention that at values>0.5%, copper increases the precipitation tendency of chromium nitrides, which has a negative effect on the corrosion properties. According to the invention, the upper limit for copper is set to <0.5%, preferably less than 0.15%, and most preferably below the detection limit.

Cobalt can be present in concentrations of up to 5% by weight, particularly in order to substitute for nickel. The upper limit for cobalt can be selected as 5, 3, 1, 0.5, 0.4, 0.3, 0.2, 0.1%, or below the detection limit (i.e. without any intentional addition to the alloy).

Nitrogen in concentrations of 0.50 to 0.90% by weight is included in order to ensure a high strength. Nitrogen also contributes to the corrosion resistance and is a powerful austenite promoter, which is why concentrations of greater than 0.50% by weight, in particular greater than 0.52% by weight, are beneficial. In order to avoid nitrogen-containing precipitations, in particular chromium nitride, the upper limit of nitrogen is set to 0.90% by weight; it has turned out that despite the very low manganese content, by contrast with known alloys, these high nitrogen concentrations in the alloy can be achieved. Because of the good nitrogen solubility on the one hand and the disadvantages that result from higher nitrogen concentrations, in particular ones above 0.90%, a pressure-induced nitrogen content increase as part of a PESR route is in fact out of the question. This route is also unnecessary thanks to the low molybdenum content according to the invention that is compensated for by means of chromium and nitrogen. It is particularly advantageous if the ratio of nitrogen to carbon is greater than 15. The lower limit for nitrogen can be selected as 0.50, 0.52, 0.54, 0.60, or 0.65%. The upper limit for nitrogen can be selected as 0.80, 0.85, or 0.90%.

According to the general prior art (V. G. Gavriljuk and H. Berns; "High Nitrogen Steels," p. 264, 1999), CrNiMn(Mo) austenitic steels that are melted at atmospheric pressure like the present ones achieve nitrogen concentrations of 0.2 to 0.5%. Only chromium-manganese-molybdenum austenites achieve nitrogen concentrations of 0.5 to 1%.

According to the invention, it is advantageous that very high nitrogen concentrations are achieved nonetheless and no pressure-induced nitrogen content increase is required.

Moreover, boron, aluminum, and sulfur can be contained as additional alloy components, but they are only optional. The present steel alloy does not necessarily contain the alloy components vanadium and titanium. Although these elements do make a positive contribution to the solubility of nitrogen, the high nitrogen solubility according to the invention can be provided even in their absence.

The alloy according to the invention should not contain niobium since it can form precipitation, which reduces the toughness. Historically, niobium was used only for bonding to carbon, which is not necessary with the alloy according to the invention. Concentrations of up to 0.1% niobium are still tolerable, but should not exceed the concentration of inevitable impurities.

BRIEF DESCRIPTION OF THE DRAWING

The invention will be explained by way of example based on the drawing. In the drawing:

FIG. 1: shows a very schematic depiction of the production route and its alternatives.

DETAILED DESCRIPTION OF THE INVENTION

Figure 2:
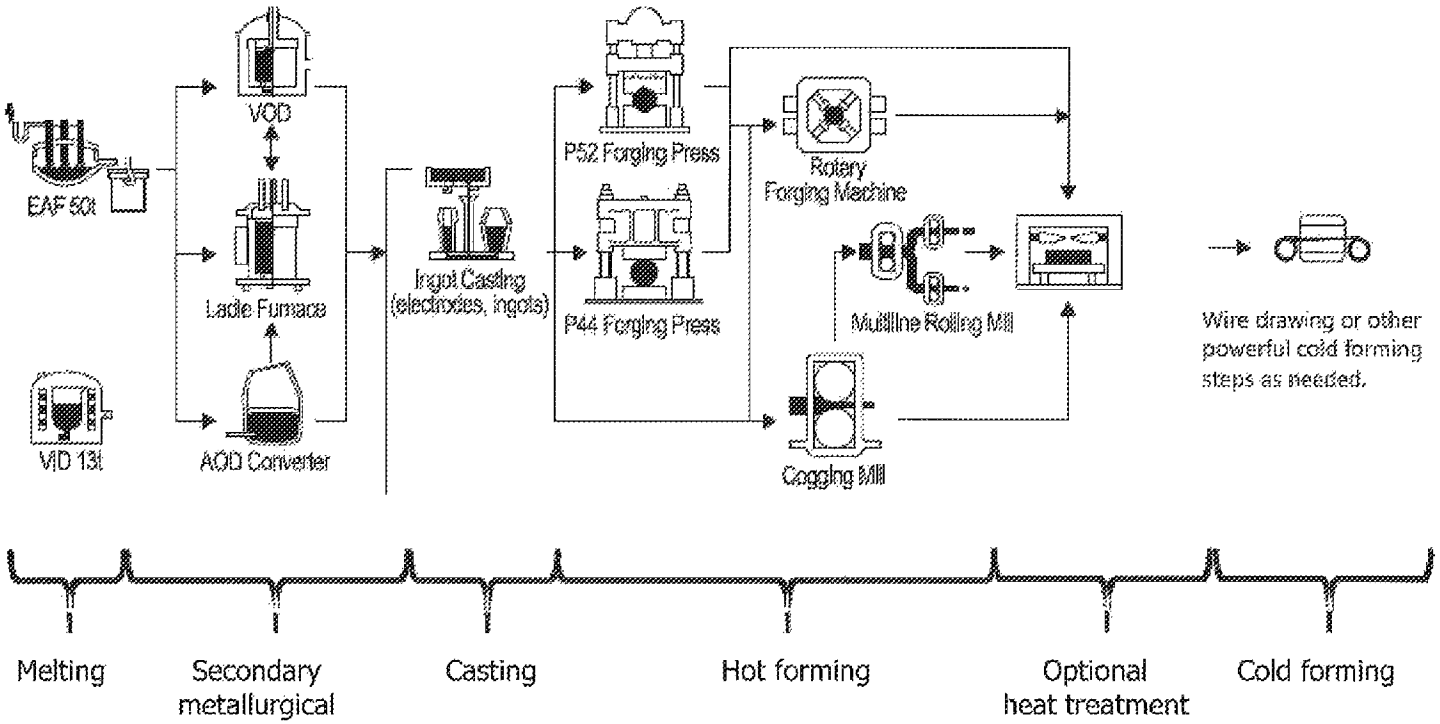

Table 1 shows the composition of the alloy with the ranges of each ingredient expressed in percent by weight.

TABLE 1

| Alloy Composition, % By Weight | | | |
|---|---|---|---|
| Alloying element | Composition range | Preferred | More preferred |
| Carbon (C) | 0.01-0.25 | 0.01-0.20 | 0.01-0.10 |
| Silicon (Si) | <0.5 | <0.5 | <0.5 |
| Manganese (Mn) | 3.0-8.0 | 4.0-7.0 | 5.0-6.0 |
| Phosphorus (P) | <0.05 | <0.05 | <0.05 |
| Sulfur (S) | <0.005 | <0.005 | <0.005 |
| Iron (Fe) | residual | residual | residual |
| Chromium (Cr) | 23.0-30.0 | 24.0-28.0 | 26.0-28.0 |
| Molybdenum (Mo) | 2.0-4.0 | 2.5-3.5 | 2.5-3.5 |
| Nickel (Ni) | 10.0-16.0 | 12.0-15.5 | 13.0-15.0 |
| Vanadium (V) | <0.5 | <0.3 | below detection limit |
| Tungsten (W) | <0.5 | <0.1 | below detection limit |
| Copper (Cu) | <0.5 | <0.15 | <1.0 |
| Cobalt (Co) | <5.0 | <0.5 | below detection limit |
| Titanium (Ti) | <0.1 | <0.05 | below detection limit |
| Aluminum (Al) | <0.2 | <0.1 | <0.1 |
| Niobium (Nb) | <0.1 | <0.025 | below detection limit |
| Boron (B) | <0.01 | <0.005 | <0.005 |
| Nitrogen (N) | 0.50-0.90 | 0.52-0.85 | 0.54-0.80 |

Table 2 shows three different alloys within the concept according to the invention and the resulting actual values of the nitrogen content compared to the theoretical nitrogen solubility of such an alloy according to the prevailing school of thought.

TABLE 2

| Examples of the Invention | | | | | | | | | | | | | | | |
|---|---|---|---|---|---|---|---|---|---|---|---|---|---|---|---|
| | Chemical composition (percentage by weight)/residual Fe | | | | | | | | | | | | | | Pressure |
| Example | C | Si | Mn | Cr | Mo | Ni | V | W* | Cu | Co* | Ti* | Al* | Nb* | N | [MPa] |
| A | 0.01 | 0.4 | 5.0 | 23.01 | 3.1 | 15.98 | 0.05 | 0 | 0.15 | 0 | 0 | 0 | 0 | 0.51 | 1.00 |
| B | 0.01 | 0.4 | 5.0 | 27 | 3.1 | 14 | 0.05 | 0 | 0.10 | 0 | 0 | 0 | 0 | 0.7 | 1.00 |
| C | 0.01 | 0.4 | 5.0 | 24 | 3.1 | 14 | 0.05 | 0 | 0.10 | 0 | 0 | 0 | 0 | 0.55 | 1.00 |

| | N solubility [% N]** | | | | | | |
|---|---|---|---|---|---|---|---|
| | | | | Medovar at temperature: | | | |
| Example | Stein | Satir | Kowanda | 1550° C. | 1525° C. | 1500° C. | 1450° C. |
| A | 0.36 | 0.30 | 0.34 | 0.34 | 0.35 | 0.36 | 0.39 |
| B | 0.61 | 0.41 | 0.65 | 0.47 | 0.49 | 0.51 | 0.56 |
| C | 0.44 | 0.34 | 0.45 | 0.38 | 0.40 | 0.41 | 0.45 |

*Values are below the detectable level

**Calculated values for N according to different methods (Source: On Restricting Aspects in the Production of Nonmagnetic Cr-Mn-N-Alloved Steels, Saller, 2005

*Values are below the detectable level

**Calculated values for N according to different methods (Source: On Restricting Aspects in the Production of Nonmagnetic Cr—Mn—N-Alloyed Steels, Saller, 2005

Table 3 shows the mechanical properties of the Examples in Table 2, after strain hardening.

TABLE 3

| Mechanical Properties | | | | | |
|---|---|---|---|---|---|
| Alloy | Rp 0.2 [MPa] | Rm [MPa] | A4 [%] | Charpy V notched-bar toughness [Joule] | Rm * KV [MPa J] |
| A | 969 | 1111 | 30 | 271 | 301303 |
| B | 1171 | 1231 | 27 | 290 | 357236 |
| C | 1124 | 1207 | 26 | 329 | 370588 |

The components are melted under atmospheric conditions and then undergo secondary metallurgical processing. Then, blocks are cast, which are hot forged immediately afterward. In the context of the invention, "immediately afterward" means that no additional remelting process such as electroslag remelting (ESR) or pressure electroslag remelting (PESR) is carried out.

According to the invention, it is advantageous if the following relation applies:

$$MARC_{opt}: 40 < wt\ \%\ Cr + 3.3 \times wt\ \%\ Mo + 20 \times wt\ \%\ C + 20 \times wt\ \%\ N - 0.5 \times wt\ \%\ Mn$$

The MARC formula is optimized to such an effect that it has been discovered that the otherwise usual removal of nickel does not apply to the system according to the invention and the limit of 40 is required.

Then cold forming steps are carried out as needed in which a strain hardening takes place, followed by the mechanical processing, which in particular can be a turning, milling, or peeling.

FIG. 1 shows examples of the possible processing routes for the production of the alloy composition according to the invention. One possible route will be described below by way of example. In the vacuum induction melting unit (VID), molten metal simultaneously undergoes melting and secondary metallurgical processing. Then the molten metal is poured into ingot molds and in them, solidifies into blocks. These are then hot formed in multiple steps. For example, they are pre-forged in the rotary forging machine and are brought into their final dimensions in the multiline rolling mill. Depending on the requirements, a heat treatment step can also be performed.

In order to further increase the strength, the cold forming step can be performed by means of wire drawing.

A superaustenitic material according to the invention can be produced not only by means of the production routes described (and in particular shown in FIG. 2), the advantageous properties of the alloy according to the invention can also be achieved by means of a production route using powder metallurgy.

Table 2 (above) shows three different variants within the alloy compositions according to the invention, with the respectively measured nitrogen values, which have been produced with the method according to the invention in connection with the alloys according to the invention. These very high nitrogen concentrations contrast with the nitrogen solubility indicated in the columns on the right according to Stein, Satir, Kowandar, and Medovar from "On restricting aspects in the production of non-magnetic Cr—Mn—N-alloy steels, Saller, 2005." In Medovar, different temperatures are indicated. It is clear, however, that the high nitrogen values far exceed the theoretically expected values.

In Table 3 (above), the three alloys from Table 2 are produced using a method according to the invention and have undergone a strain hardening.

After this strain hardening, in all three materials, $R_{p0.2}$ was approximately 1000 MPa and the tensile strength Rm of each was between 1100 MPa and 1250 MPa. In addition, the notched bar impact work was in the outstanding range from 270 J to even greater than 300 J (alloy C—329.5 J).

It was thus possible to achieve an outstanding combination of strength and toughness; in all three examples, the product of Rm*KV was greater than 300000 MPa J.

This is even more astonishing since with the alloy according to the invention, a route was taken that does not in fact justify the expectation of a high nitrogen solubility, particularly because the manganese content, which has a very positive influence on the nitrogen solubility, is sharply reduced compared to known corresponding alloys.

The invention therefore has the advantage that an austenitic, high-strength material with an increased corrosion resistance and low nickel content is produced, which simultaneously exhibits high strength and paramagnetic behavior. Even after the cold forming, a fully austenitic structure is present so that it has been possible to successfully combine the positive properties of an inexpensive CrMnNi steel with the outstanding technical properties of a CrNiMo steel.

One special feature of the invention is that because of the high nitrogen content, the strain hardening rate is higher than in other superaustenites in order to thus be able to achieve tensile strengths ($R_m$) of 2500 MPa. It is thus possible as a last production step to achieve a high strain hardening by means of drawing procedures or other cold forming processes, preferably processes with high deformation rates.

Typical application fields of the materials according to the invention are shipbuilding, particularly submarine construction, chemical plant construction, seawater purification plants, the paper industry, screws and bolts, flexible pipes, so-called wire lines, completion tools, springs, valves, umbilicals, axle drives, and pumps. In this connection, slight alloy adjustments can be made depending on the area of use, which are shown in Table4.

TABLE 4

Uses of Inventive Alloys

| | C (%) | Si (%) | Mn (%) | Cr (%) | Mo (%) | Ni (%) | Nb (%) | N (%) | Use |
|---|---|---|---|---|---|---|---|---|---|
| LL | 0.010 | 0* | 3.00 | 23.0 | 2.50 | 14.00 | 0* | 0.50 | Shipbuilding, chemical plant construction |
| UL | 0.030 | 0.50 | 6.00 | 25.0 | 3.50 | 16.00 | 0.10 | 0.60 | |
| LL | 0.010 | 0* | 4.00 | 23.50 | 3.00 | 12.00 | 0* | 0.50 | Axle drives, pumps, seawater purification |
| UL | 0.030 | 0.50 | 7.00 | 26.00 | 4.00 | 15.00 | 0.10 | 0.70 | plants |
| LL | 0.010 | 0* | 5.00 | 26.00 | 3.00 | 11.00 | 0* | 0.50 | Flexible pipes, wire lines, screws and bolts, |
| UL | 0.050 | 0.50 | 8.00 | 30.00 | 4.00 | 14.50 | 0.10 | 0.90 | completion tools |

LL = Lower Limit
UL = Upper Limit
*Values are below detection limit and elements aree not intentionally added Especially in applications such as screws and bolts, flexible pipes, wire lines, umbilicals, etc. in which very high strengths are required, the strength can be increased even more by means of cold deformation, as described above.

The invention claimed is:

1. A precipitation-free superaustenitic material comprising an alloy with the following alloy elements in % by weight:

| Elements | |
|---|---|
| Carbon (C) | 0.01-0.25 |
| Silicon (Si) | <0.5 |
| Manganese (Mn) | 3.0-8.0 |
| Phosphorus (P) | <0.05 |
| Sulfur (S) | <0.005 |
| Iron (Fe) | residual |
| Chromium (Cr) | 23.0-30.0 |
| Molybdenum (Mo) | 2.0-4.0 |
| Nickel (Ni) | 10.0-16.0 |
| Vanadium (V) | <0.5 |
| Tungsten (W) | <0.5 |
| Copper (Cu) | <0.5 |
| Cobalt (Co) | <5.0 |
| Titanium (Ti) | <0.1 |
| Aluminum (Al) | <0.2 |
| Niobium (Nb) | <0.1 |
| Boron (B) | <0.01 |
| Nitrogen (N) | 0.50-0.90 |

balance Iron (Fe) and inevitable impurities;

wherein the precipitation-free superaustenitic material is cold-formed with sufficient deformation to yield a tensile strength Rm of at least 1100 MPa, a notched-bar toughness KV of at least 80 J, and Rm multiplied by KV is greater than 100,000 MPa-J.

2. The precipitation-free superaustenitic material according to claim 1, wherein the alloy comprises the following elements in % by weight:

| Elements | |
|---|---|
| Carbon (C) | 0.01-0.20 |
| Silicon (Si) | <0.5 |
| Manganese (Mn) | 4.0-7.0 |
| Phosphorus (P) | <0.05 |
| Sulfur (S) | <0.005 |
| Iron (Fe) | residual |
| Chromium (Cr) | 24.0-28.0 |
| Molybdenum (Mo) | 2.5-3.5 |
| Nickel (Ni) | 12.0-15.5 |
| Vanadium (V) | <0.3 |
| Tungsten (W) | <0.1 |
| Copper (Cu) | <0.15 |

-continued

| Elements | |
|---|---|
| Cobalt (Co) | <0.5 |
| Titanium (Ti) | <0.05 |
| Aluminum (Al) | <0.1 |
| Niobium (Nb) | <0.025 |
| Boron (B) | <0.005 |
| Nitrogen (N) | 0.52-0.80 |

balance Iron (Fe) and inevitable impurities;

and Rm multiplied by KV is greater than 200,000 MPa-J.

3. The precipitation-free superaustenitic material according to claim 1, wherein the alloy comprises the following elements in % by weight:

| Elements | |
|---|---|
| Carbon (C) | 0.01-0.1 |
| Silicon (Si) | <0.5 |
| Manganese (Mn) | 5.0-6.0 |
| Phosphorus (P) | <0.05 |
| Sulfur (S) | <0.005 |
| Iron (Fe) | residual |
| Chromium (Cr) | 26.0-28.0 |
| Molybdenum (Mo) | 2.5-3.5 |
| Nickel (Ni) | 13.0-15.0 |
| Vanadium (V) | below detection limit |
| Tungsten (W) | below detection limit |
| Copper (Cu) | below detection limit |
| Cobalt (Co) | below detection limit |
| Titanium (Ti) | below detection limit |
| Aluminum (Al) | <0.1 |
| Niobium (Nb) | below detection limit |
| Boron (B) | <0.005 |
| Nitrogen (N) | 0.54-0.80 |

balance Iron (Fe) and inevitable impurities;

and Rm multiplied by KV is greater than 300,000 MPa-J.

4. The precipitation-free superaustenitic material according to claim 1, wherein the material is produced by a method comprising secondary metallurgical processing of the molten metal, casting into blocks, hot forming immediately afterward, the cold forming, and optional further mechanical processing.

5. The precipitation-free superaustenitic material according to claim 1, wherein the material has a yield strength $R_{p0.2}$ in excess of 500 MPA.

6. The precipitation-free superaustenitic material according to claim 1, wherein the material has a notched bar impact work at room temperature in the longitudinal direction Av in excess of 300 J.

7. The precipitation-free superaustenitic material according to claim 1, wherein the material is fully austenitic.

8. The precipitation-free superaustenitic material according to claim 1, wherein the manganese is present at about 3.5% to about 7% by weight of the alloy.

9. The precipitation-free superaustenitic material according to claim 1, wherein the chromium is present at greater than 25% to about 29% by weight of the alloy.

10. The precipitation-free superaustenitic material according to claim 1, wherein the molybdenum is present at about 2.3% to about 3.7% by weight of the alloy.

11. The precipitation-free superaustenitic material according to claim 1, wherein the nickel is present at about 11% to about 15% by weight of the alloy.

12. The precipitation-free superaustenitic material according to claim 1, wherein the nitrogen is present at about 0.52% to about 0.85% by weight of the alloy.

13. The precipitation-free superaustenitic material according to claim 1, wherein the cobalt is present at less than about 1% by weight of the alloy.

14. The precipitation-free superaustenitic material according to claim 1, wherein the copper is present at less than about 0.3% by weight of the alloy.

15. The precipitation-free superaustenitic material according to claim 1, wherein the tungsten is present at less than about 0.3% by weight of the alloy.

16. The precipitation-free superaustenitic material of claim 1, wherein the tensile strength Rm is at least 2000 MPa.

17. A precipitation-free superaustenitic material comprising an alloy with the following alloy elements in % by weight:

Elements
Carbon (C) 0.01-0.25
Manganese (Mn) 3.0-8.0
Chromium (Cr) 25.1-30.0
Molybdenum (Mo) 2.0-4.0
Nickel (Ni) 10.0-16.0
Vanadium (V), Tungsten (W), Silicon (Si) and Cobalt (Co) in a combined amount of zero to 2.0
Copper (Cu), Titanium (Ti), Aluminum (Al), Niobium (Nb), Boron (B), Phosphorus (P) and Sulfur(S) in a combined amount of zero to 1.0
Nitrogen (N) 0.50-0.90
balance Iron (Fe) and inevitable impurities;
wherein the precipitation-free superaustenitic material is cold-formed with sufficient deformation to yield a tensile strength Rm of at least 1100 MPa, a notched-bar toughness KV of at least 80 J, and Rm multiplied by KV is greater than 100,000 MPa-J.

18. A method for producing a precipitation-free superaustenitic material, comprising the steps of:

providing an alloy comprising the following elements in % by weight:

| Elements | |
|---|---|
| Carbon (C) | 0.01-0.25 |
| Silicon (Si) | <0.5 |
| Manganese (Mn) | 3.0-8.0 |
| Phosphorus (P) | <0.05 |
| Sulfur (S) | <0.005 |
| Iron (Fe) | residual |
| Chromium (Cr) | 23.0-30.0 |
| Molybdenum (Mo) | 2.0-4.0 |
| Nickel (Ni) | 10.0-16.0 |
| Vanadium (V) | <0.5 |
| Tungsten (W) | <0.5 |
| Copper (Cu) | <0.5 |
| Cobalt (Co) | <5.0 |

-continued

| Elements | |
|---|---|
| Titanium (Ti) | <0.1 |
| Aluminum (Al) | <0.2 |
| Niobium (Nb) | <0.1 |
| Boron (B) | <0.01 |
| Nitrogen (N) | 0.50-0.90 |

balance Iron (Fe) and inevitable impurities;

melting the alloy;

subjecting the alloy to secondary metallurgical processing;

casting the alloy into blocks and permitting the blocks to solidify;

immediately after solidifying the blocks, heating and hot forming the blocks; and cold forming and mechanically processing the blocks;

wherein the cold forming causes sufficient deformation of the precipitation-free superaustenitic material to yield a tensile strength Rm of at least 1100 MPa, a notched-bar toughness KV of at least 80 J, and Rm multiplied by KV is greater than 100,000 MPa-J.

19. The method according to claim 18, wherein the alloy comprises the following elements in % by weight:

| Elements | |
|---|---|
| Carbon (C) | 0.01-0.20 |
| Silicon (Si) | <0.5 |
| Manganese (Mn) | 4.0-7.0 |
| Phosphorus (P) | <0.05 |
| Sulfur (S) | <0.005 |
| Iron (Fe) | residual |
| Chromium (Cr) | 24.0-28.0 |
| Molybdenum (Mo) | 2.5-3.5 |
| Nickel (Ni) | 12.0-15.5 |
| Vanadium (V) | <0.3 |
| Tungsten (W) | <0.1 |
| Copper (Cu) | <0.1 |
| Cobalt (Co) | <0.5 |
| Titanium (Ti) | <0.05 |
| Aluminum (Al) | <0.1 |
| Niobium (Nb) | <0.025 |
| Boron (B) | <0.005 |
| Nitrogen (N) | 0.52-0.80 |

balance Iron (Fe) and inevitable impurities;

and Rm multiplied by KV is greater than 200,000 MPa-J.

20. The method according to claim 18, wherein the alloy comprises the following elements in % by weight:

| Elements | |
|---|---|
| Carbon (C) | 0.01-0.10 |
| Silicon (Si) | <0.5 |
| Manganese (Mn) | 5.0-6.0 |
| Phosphorus (P) | <0.05 |
| Sulfur (S) | <0.005 |
| Chromium (Cr) | 26.0-28.0 |
| Molybdenum (Mo) | 2.5-3.5 |
| Nickel (Ni) | 13.0-15.0 |
| Copper (Cu) | <0.1 |

-continued

| Elements | |
|---|---|
| Aluminum (Al) | <0.1 |
| Boron (B) | <0.005 |
| Nitrogen (N) | 0.54-0.80 |

balance Iron (Fe) and inevitable impurities;

and Rm multiplied by KV is greater than 300,000 MPa-J.

21. The method according to claim 18, wherein the hot forming comprises a plurality of sub-steps.

22. The method according to claim 18, further comprising the steps of:

re-heating the block between the sub-steps, and after the last sub-step, and optionally solution annealing after the last sub-step.

23. The method according to claim 21, further comprising the step of:

performing the cold forming of the block after the last sub-step and the optional solution annealing, in order to achieve a tensile strength Rm>2000 MPa.

* * * * *